US006886509B2

(12) United States Patent
Perez Cuadro

(10) Patent No.: US 6,886,509 B2
(45) Date of Patent: May 3, 2005

(54) HYDRAULIC ACTUATOR FOR ACTUATING A GAS EXCHANGE VALVE OF AN INTERNAL COMBUSTION ENGINE

(75) Inventor: Diogenes Perez Cuadro, Korntal-Münchingen (DE)

(73) Assignee: Mahle Ventiltrieb GmbH, Stuttgart (DE)

( * ) Notice: Subject to any disclaimer, the term of this patent is extended or adjusted under 35 U.S.C. 154(b) by 0 days.

(21) Appl. No.: 10/363,790

(22) PCT Filed: Mar. 16, 2002

(86) PCT No.: PCT/DE02/00947

§ 371 (c)(1),
(2), (4) Date: Mar. 5, 2003

(87) PCT Pub. No.: WO02/077421

PCT Pub. Date: Oct. 3, 2002

(65) Prior Publication Data

US 2004/0094104 A1 May 20, 2004

(30) Foreign Application Priority Data

Mar. 21, 2001 (DE) ..... 101 13 722

(51) Int. Cl.[7] ..... F01L 9/02

(52) U.S. Cl. ..... 123/90.12; 123/90.15; 123/198 C; 417/44.1; 417/322; 417/410.1; 417/410.2; 222/287; 222/309; 222/401; 222/402; 60/426

(58) Field of Search ..... 123/90.12, 90.13, 123/90.15, 198 C; 417/44.1, 322, 410.1, 410.2; 222/287, 309, 310, 373, 386, 401, 402; 60/419–422, 428–432, 473, 474, 487–491, 494

(56) References Cited

U.S. PATENT DOCUMENTS

| | | | | | |
|---|---|---|---|---|---|
| 4,200,067 | A | * | 4/1980 | Trenne | 123/90.12 |
| 4,206,728 | A | * | 6/1980 | Trenne | 123/90.12 |
| 4,593,658 | A | * | 6/1986 | Moloney | 123/90.11 |
| 5,101,797 | A | * | 4/1992 | Sturz et al. | 123/496 |
| 6,321,702 | B1 | * | 11/2001 | Diehl et al. | 123/90.12 |

FOREIGN PATENT DOCUMENTS

| | | | | |
|---|---|---|---|---|
| CH | 536 934 | | 6/1973 | |
| DE | 198 26 045 | | 1/2000 | |
| DE | 198 39 732 | | 3/2000 | |
| JP | 5-202708 | | 8/1993 | |
| JP | 05202712 | A * | 8/1993 | F01L/9/02 |
| JP | 09329009 | | 12/1997 | |
| WO | WO 9966178 | A1 * | 12/1999 | F01L/9/02 |

OTHER PUBLICATIONS

Camless Engine, Schechter et al, Sae Technical Paper Series, 960581, Feb. 1996 (Enclosed).

* cited by examiner

*Primary Examiner*—Thomas Denion
*Assistant Examiner*—Kyle M. Riddle
(74) *Attorney, Agent, or Firm*—Collard & Roe, P.C.

(57) ABSTRACT

The invention relates to a hydraulic actuator for actuating a gas exchange valve (1) of an internal combustion engine, which valve is especially closed by the effect of a spring. The actuator is configured by a feed pump (6) with intermittent and thus variable delivery. The feed pump (6) has a high frequency and can be equipped for this purpose with piezoelectric, magnetorestrictive and/or electrochemical actuators as the feed elements. Optionally, the feed pump (6) can be operated with a stop valve (7) that is disposed downstream of the gas exchange valve (1) and that is controlled or regulated depending on the feed pump.

13 Claims, 9 Drawing Sheets

Figure 1A:
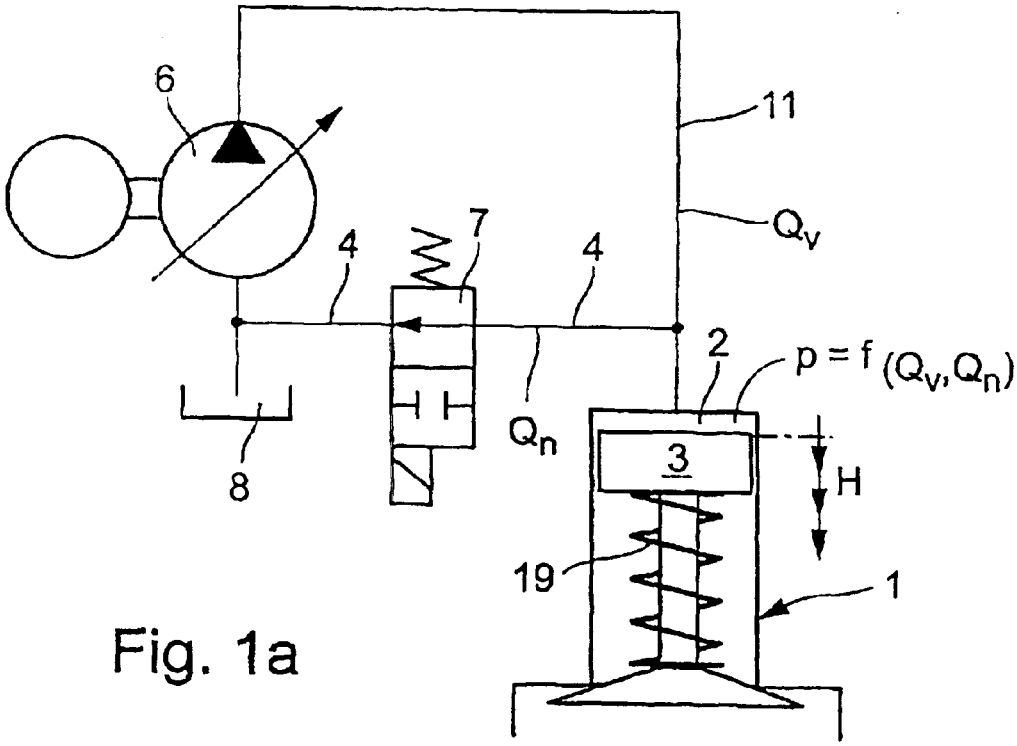

HYDRAULIC ACTUATOR FOR ACTUATING A GAS EXCHANGE VALVE OF AN INTERNAL COMBUSTION ENGINE

CROSS REFERENCE TO RELATED APPLICATIONS

Applicant claims priority under 35 U.S.C. §119 of German Application No. 101 13 722.2, filed: Mar. 21, 2001. Applicant also claims priority under 35 U.S.C. §365 of PCT/DE02/00947, filed: Mar. 16, 2002. The international application under PCT article 21 (2) was not published in English.

This invention relates to a hydraulic actuator according to the preamble of claim 1 and a method of operating this actuator according to claim 13.

Such an actuator is known from Swiss Patent 536 934 A.

A hydraulic actuator which operates according to the principle of a hydraulic pendulum is known from the SAE paper 960581 with the title "Camless Engine" by the authors Michael M. Schechter and Michael B. Levin, based on a lecture at the International Congress and Exposition in Detroit, Michigan on Feb. 26 through 29, 1996.

This invention is concerned with the problem of simplifying the design of a generic actuator and designing it so that variable, i.e., different lift distances can be achieved easily and reliably in opening the gas exchange valve.

A generic actuator having the characterizing features of Patent claim 1 provides a fundamental solution to this problem. An especially expedient method of operating such a device is the object of claim 13.

A piezoelectric-hydraulic actuating device for gas exchange valves of internal combustion engines with which different lift distances are fundamentally achievable when opening a gas exchange valve is already known from German Patent Application 198 39 732 A1, where piezo elements act as displacement actuators on a hydraulic transmission system, i.e., a uniform quantity of hydraulic fluid is displaced to actuate the valve. A piezo actuator according to Japanese Patent 5-20 27 08 A2 also operates in the same way with an engine valve system.

In comparison with the two piezo actuators mentioned last, which are known as hydraulic actuators, the embodiment according to this invention is based on the idea of not displacing a constant volume of a hydraulic fluid but instead delivering hydraulic fluid with a pump which operates at a high frequency, and on operating the gas exchange valves with the quantity of hydraulic fluid delivered and/or actuating the gas exchange valves as a function of the volume flow delivered. With the embodiment according to this invention, this yields the advantage in comparison with the drives known in the past that the device has a small design and is independent of the camshaft for actuation of the gas exchange valves of an internal combustion engine. In the case of feed pumps with piezo actuators, a small design is obtained for example due to the fact that the number of piezo elements with which only a small extent is achievable in each case can remain small to achieve a sufficiently large displacement volume. In addition, with the solution according to this invention, no provisions need be taken to compensate for hydraulic fluid leakage losses because there is no hermetically sealed hydraulic system according to this invention.

In comparison with the generic state of the art described above, another advantage of this invention is that it is sufficient to have a high-pressure reservoir and a switching stop valve situated upstream from the gas exchange valve, and furthermore a variable lift position of the gas exchange valve can be achieved easily and safely. In addition, the device according to this invention operates in a power-saving mode because the feed pump cannot operate continuously but instead operates only intermittently to open or close the valve. The feed pump usually operates to open the gas exchange valve, but its closing action takes place under the force of a restoring spring. The gas exchange valve could also essentially close by hydraulic means and open under the force of a restoring spring. In addition, according to this invention, the valve may also be operated according to the principle of a hydraulic pendulum.

It is important for the implementation of the teaching according to this invention that an accurately controllable and/or regulable feed pump which operates at a high frequency is used. Suitable feed pumps of this type according to this invention include in particular those having piezoelectric, magnetostrictive and/or electrochemical actuators as delivery elements. The displacement volume of hydraulic fluid necessary for opening or closing a gas exchange valve against an opposing force can be generated in the circulation by the fact that the circulating flow is entirely suppressed or at least dammed up during the hydraulically actuated opening or closing operation downstream from the gas exchange valve, thereby creating a great flow resistance downstream, so that opening or closing of the gas exchange valve can be accomplished by overcoming this opposing force. The damming up may be accomplished by a throttled flow cross section. This cross section can be varied accordingly for opening and closing the gas exchange valve of the respective function. However, it is also possible to leave the throttle cross section unchanged and to vary only the delivery volume of the hydraulic fluid in accordance with the function for opening and/or closing the gas exchange valves. The hydraulic force acting on a gas exchange valve which is to be actuated thus depends on the difference between the volume flow upstream and downstream from the gas exchange valve within the hydraulic fluid circuit during the same period of time. In the case of a hydraulic pressure p on the gas exchange valve, a volume flow Qv upstream from the gas exchange valve and a volume Qn downstream from the qas exchange valve, this yields the following functional dependence for the hydraulic pressure available at the gas exchange valve for opening or closing it: $p=f(Q_v, Q_n)$.

Expedient embodiments of the actuator for gas exchange valves of an internal combustion engine are the object of the subclaims.

In the case of opening and closing the gas exchange valve under a hydraulic force according to this invention, the respective opposing movement of the gas exchange valve takes place under an opposing force, which may be generated by a mechanical spring in particular. The respective return movement should be dampened if possible. To this end, a flow cross section located downstream from the gas exchange valve within the hydraulic fluid circuit may be throttled temporarily, i.e., during the desired damping time. However, during the return movement of the gas exchange valve, it is also possible according to claim 13 for a damping force to be produced by a temporary increase in the delivery volume flow of hydraulic fluid with a uniform circulation flow cross section, downstream from the gas exchange valve in particular. In this way, no control valve is necessary downstream from the gas exchange valve in particular, i.e., if a valve is used there at all, a simple cut-off valve is sufficient.

The device according to this invention also permits in particular actuation of the gas exchange valves in a braking operation of the internal combustion engine.

Feed pumps having piezoelectric, magnetostrictive and/or electrochemical actuators as delivery elements and optionally similarly actuated pump valves which can be used expediently and to advantage for the present invention are also suitable in the same way in particular as injection pumps for internal combustion engines.

Exemplary embodiments of this invention on the basis of which the claimed embodiments are explained in greater detail are illustrated in the drawing.

Figure 1B:
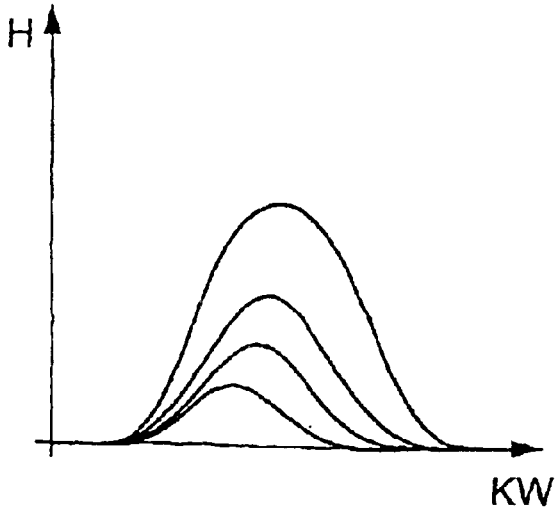
Figure 1C:
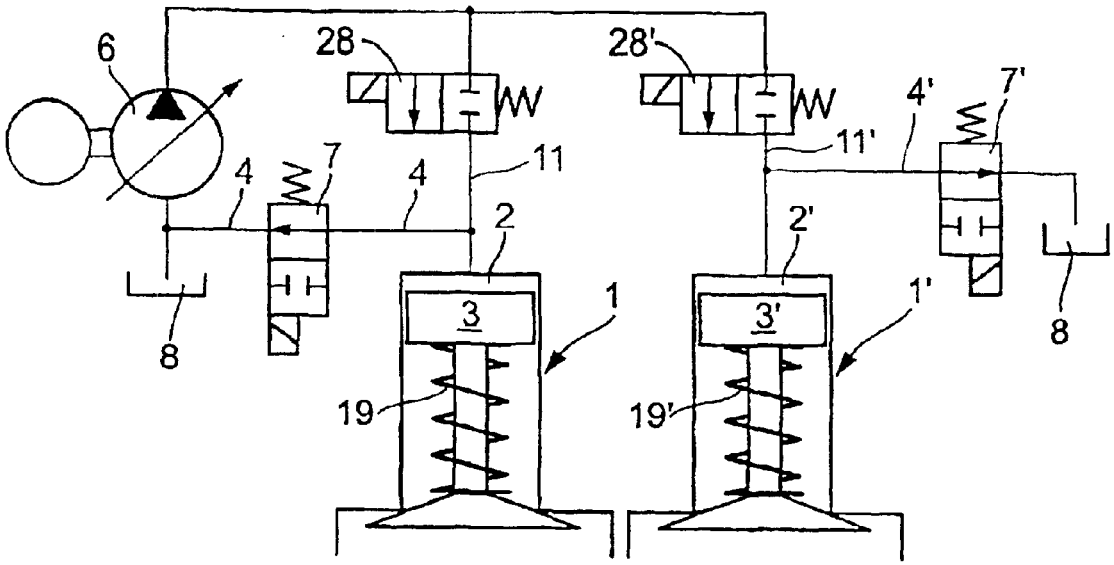
Figure 1D:
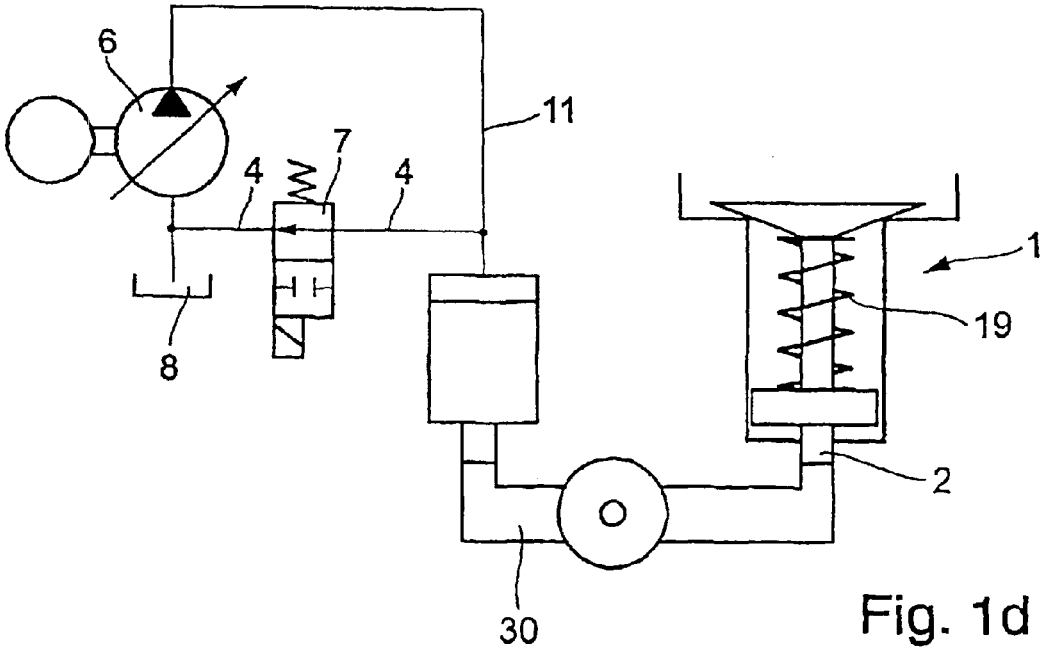
Figure 2:
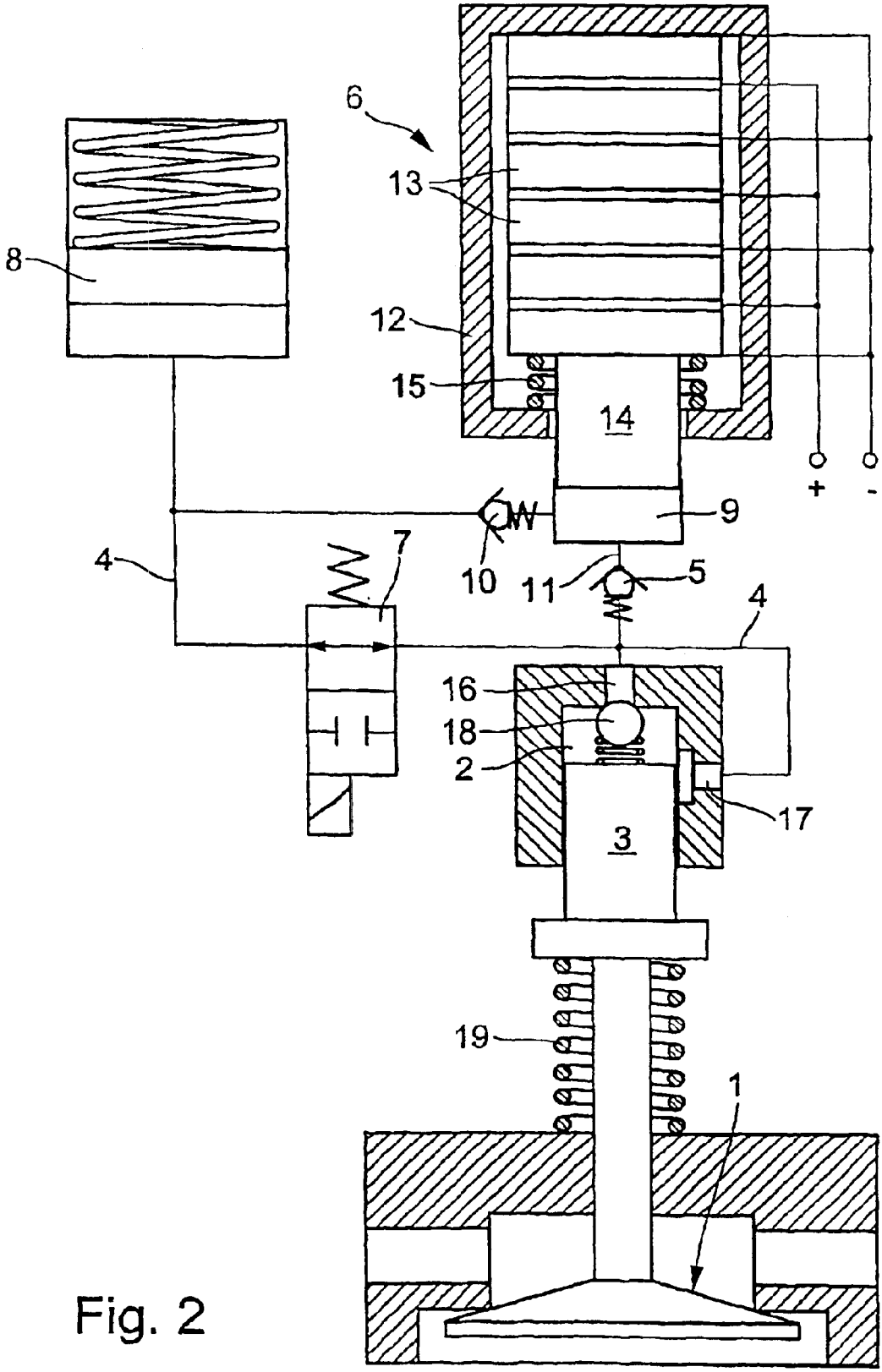
Figure 3:
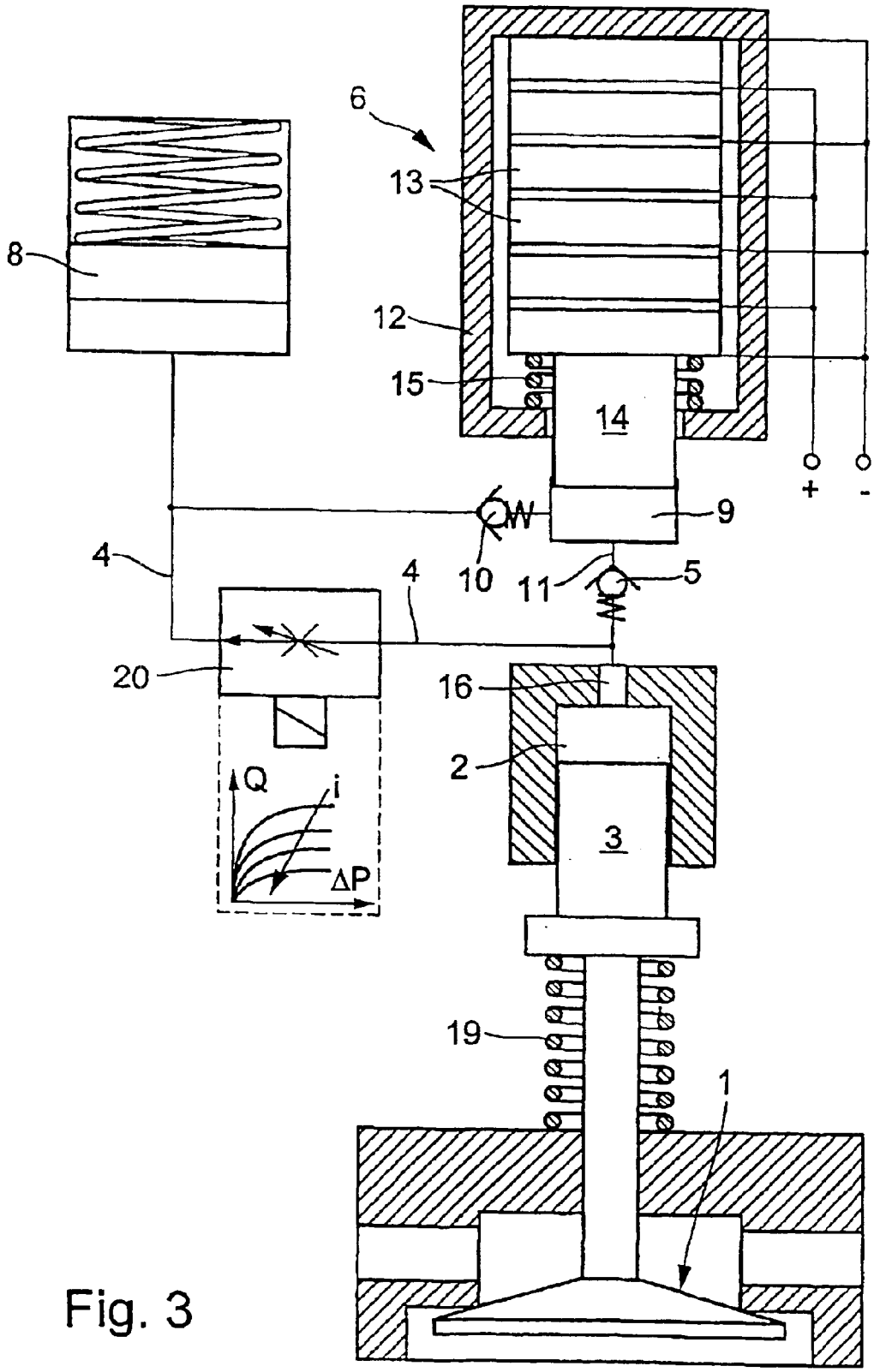
Figure 4:
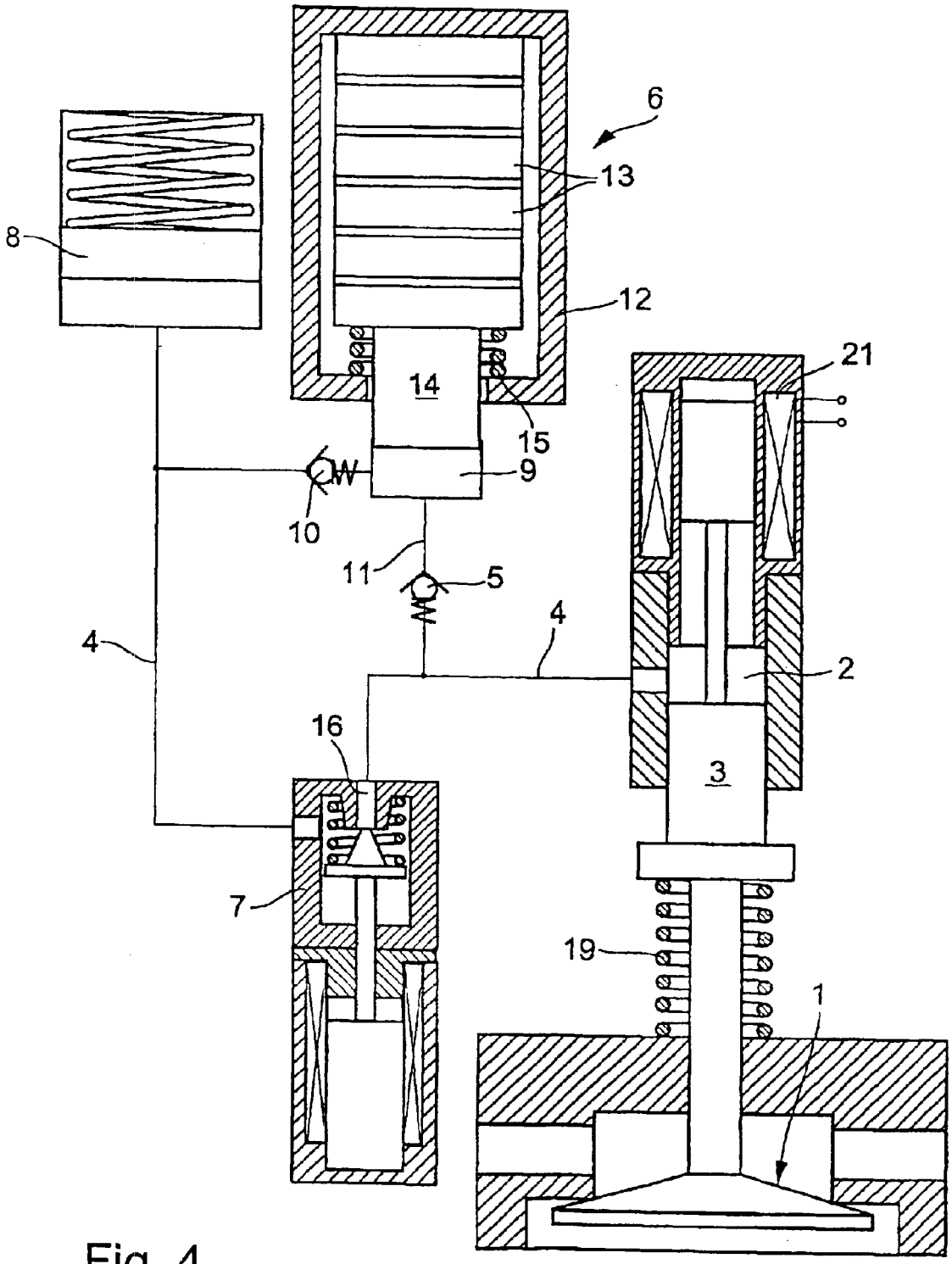
Figure 5:
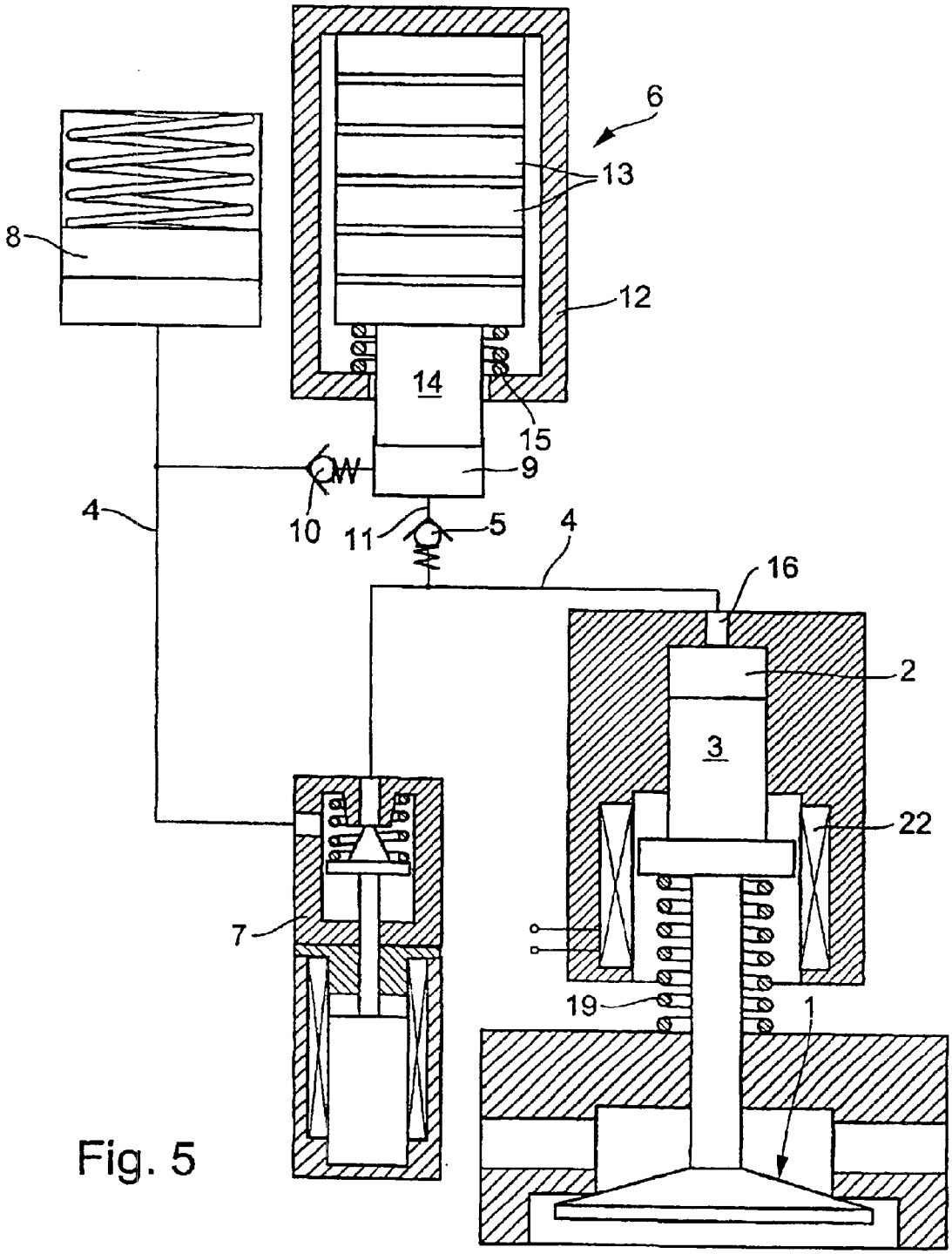
Figure 6:
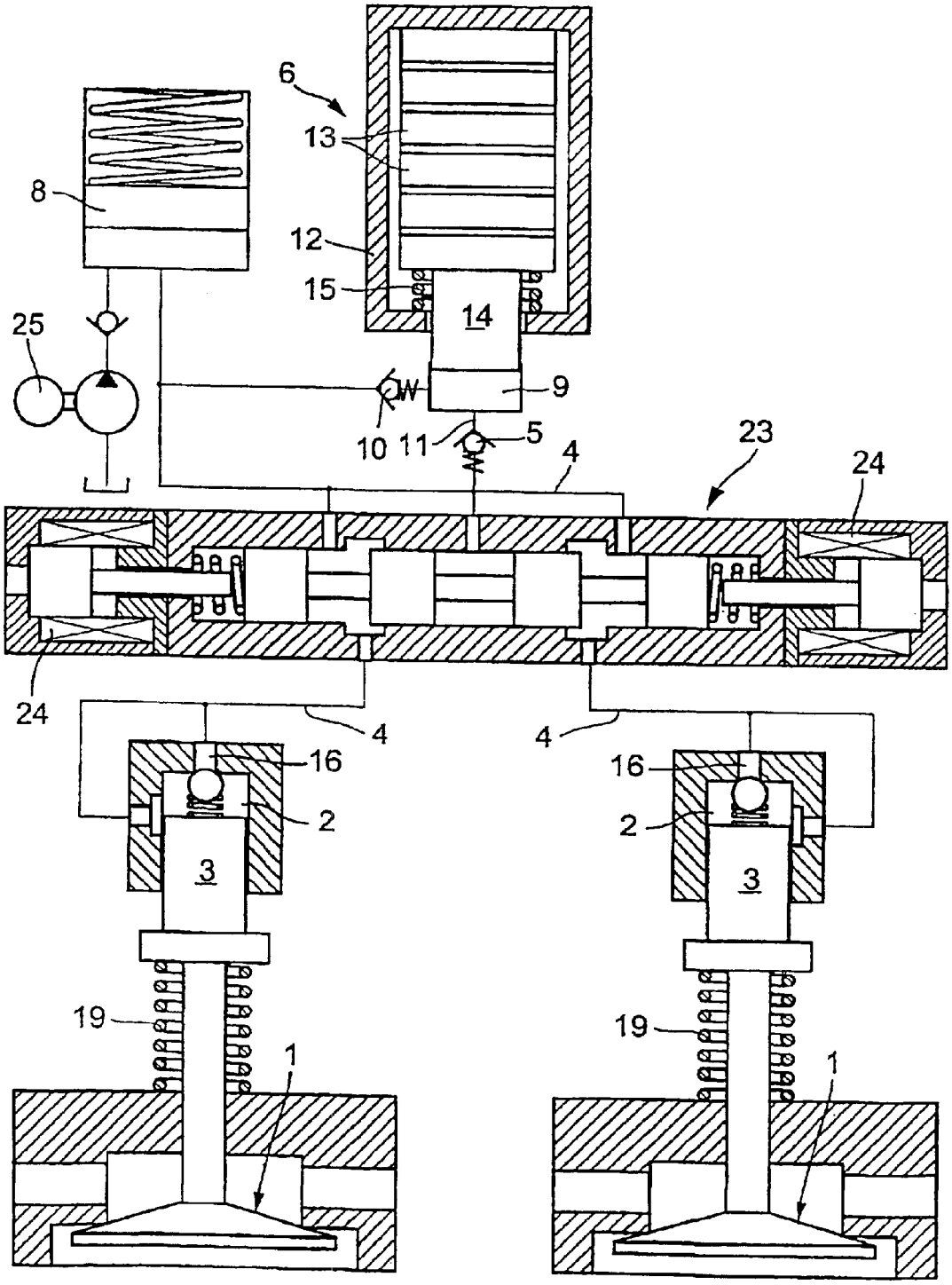
Figure 7:
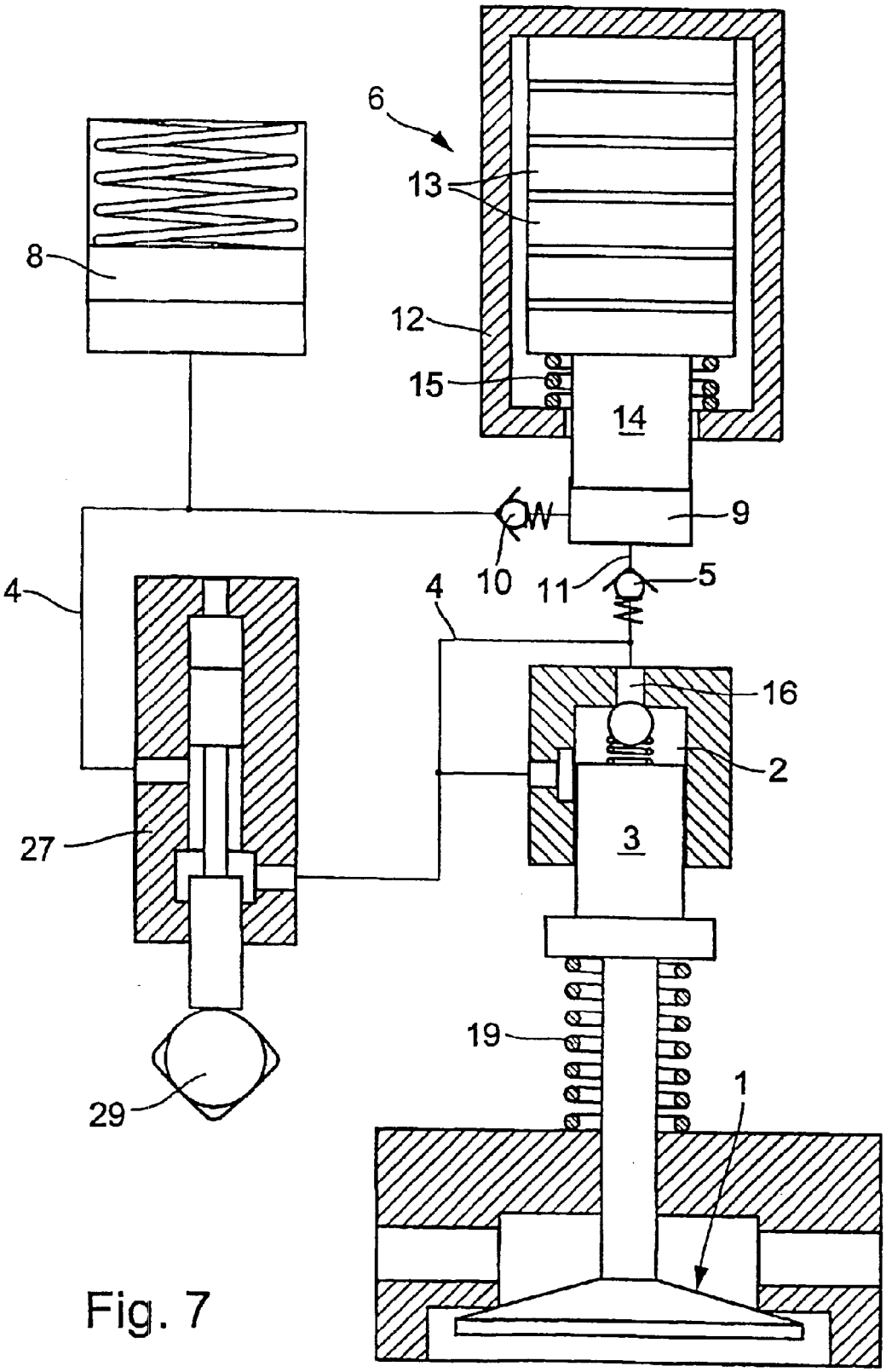
Figure 8:
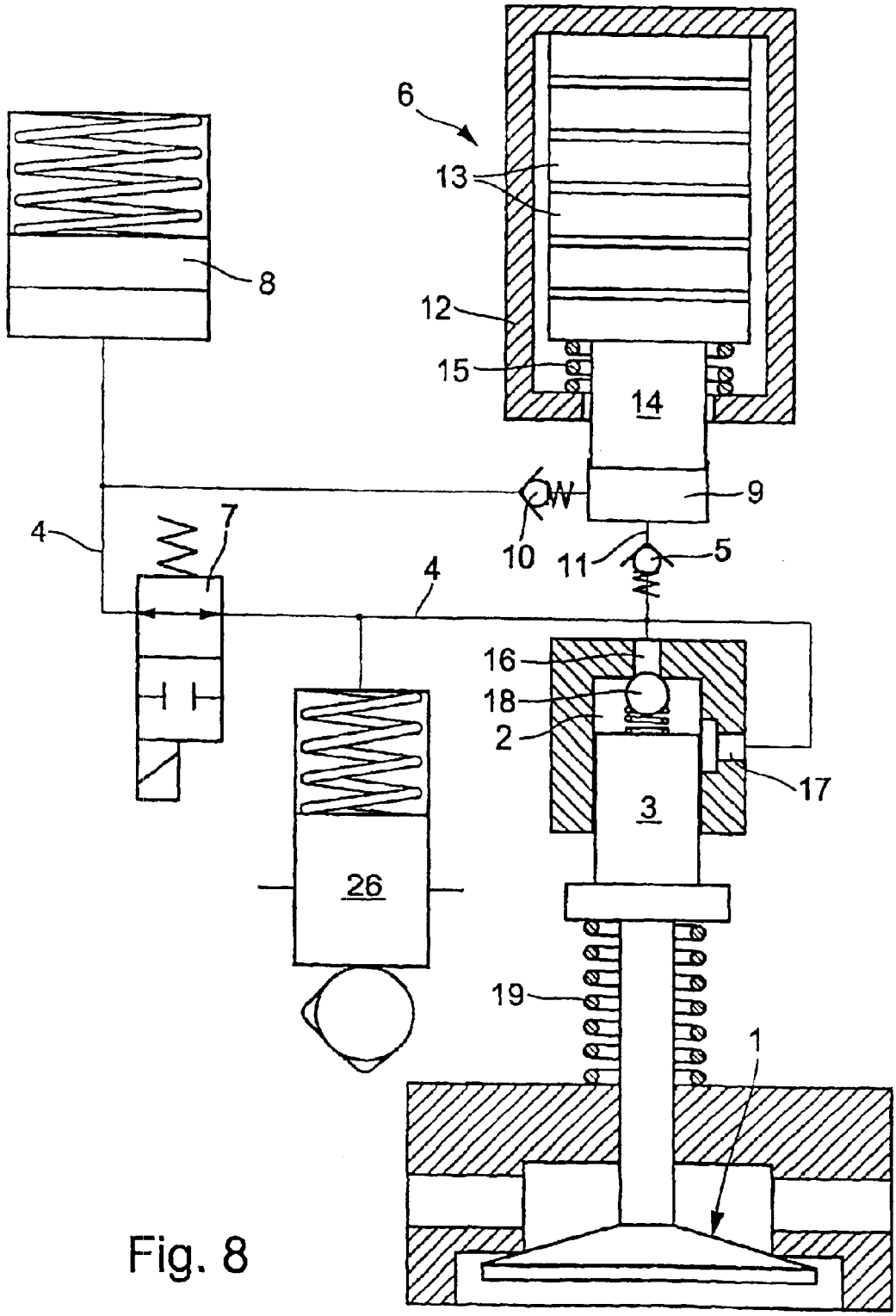

The drawing shows in schematic diagrams:

FIG. 1*a* an actuating device for a gas exchange valve with an intermittently operating high-frequency feed pump and a 2/2 switching valve as a stop valve;

FIG. 1*b* a diagram showing the crankshaft angles KW of an internal combustion engine plotted on the abscissa and the opening lift H of the gas exchange valve plotted on the coordinate to illustrate different opening stroke lengths available with the device according to this invention;

FIG. 1*c* an actuating device according to FIG. 1*a* for several gas exchange valves;

FIG. 1*d* an actuating device according to FIG. 1*a* with a mechanical transmission;

FIG. 2 an actuating device according to FIG. 1 with a feed pump designed as a piezo pump;

FIG. 3 a device according to FIG. 2 with a regulating valve instead of a 2/2 switching valve;

FIG. 4 a device according to FIG. 2 with a 2/2 switching valve, shown structurally, and a displacement sensor on the gas exchange valve to be operated in a first embodiment of the displacement sensor;

FIG. 5 a device according to FIG. 4 with a second embodiment of the displacement sensor;

FIG. 6 a device according to FIG. 2 with a switching device for reciprocal actuation of a plurality of gas exchange valves by a common piezo pump;

FIG. 7 a device according to FIG. 2 with a camshaft-actuated 2/2-way valve as a stop valve;

FIG. 8 a device according to FIG. 2 with an actuator which intervenes additionally in the adjusting hydraulic system for braking operation of the internal combustion engine having the gas exchange valves.

The hydraulic actuator device diagramed schematically in FIG. 1*a* is composed of the following elements.

A high-frequency, intermittently or continuously operable feed pump 6 conveys hydraulic fluid in a circulation system. Hydraulic fluid is drawn out of a storage container 8 and conveyed back into storage container 8 through lines 11 and 4, and a stop valve designed as a 2/2-way switching valve 7. On route between feed pump 6 and the 2/2 switching valve, a gas exchange valve 1 is connected to the circulating line via a hydraulic chamber 2 of the gas exchange valve 1. A change in volume of hydraulic chamber 2 results in a proportional lift adjustment of the gas exchange valve 1. The lift path is indicated with arrows H in FIG. 1*a*. A mechanical spring 19 is provided for the return movement of the gas exchange valve 1 against a hydraulically actuated adjustment.

This actuating device functions as follows.

The gas exchange valve 1 is held in the closed position by spring 19 in the absence of an opposing hydraulic force. To open gas exchange valve 1, feed pump 6 conveys hydraulic fluid with a volume flow $Q_v$ into line 11 with the 2/2 switching valve closed. The hydraulic fluid conveyed thus penetrates into hydraulic chamber 2 of gas exchange valve 1 and thus causes the opening of gas exchange valve 1. To close the gas exchange valve 1, the delivery operation of feed pump 8 [sic; 6] is interrupted and the 2/2 switching valve is switched to continuous flow. Delivery operation is preferably interrupted by a shutdown of feed pump 6 which corresponds to the valve closing time. Feed pump 6 must be a high-frequency pump that can be switched without delay in the shortest possible intervals of time. In particular, feed pumps 6 having piezoelectric, magnetostrictive and/or electrochemical actuators as the delivery elements are suitable for this purpose. In the examples described below, a piezo pump is used as feed pump 6. The hydraulic force which may act on the gas exchange valve 1, depending on the delivery operation of feed pump 6, is entered in FIG. 1*a* as a function $p=f(Q_v, Q_n)$, where $Q_v$ is the delivery rate upstream from the gas exchange valve 1 and Qn is the delivery rate downstream from the gas exchange valve 1.

An important advantage of the invention described on the basis of the schematic diagram in FIG. 1*a* is that between the hydraulic chamber 2 of the gas exchange valve 1 and the feed pump 6, neither a stop valve nor a pressure reservoir is necessary between such a stop valve and the feed pump. In the known state of the art, such a stop valve must always be provided with such a device, whereby the feed pump delivers medium into the high-pressure reservoir in the closed position of that stop valve. When that stop valve is opened, hydraulic fluid is delivered essentially out of this high-pressure reservoir and into the hydraulic chamber of the gas exchange valve to achieve a rapid response.

Variable lift adjustments of the gas exchange valve 1 can be achieved through different delivery or flow rates $Q_v$ of the feed pump 6 with the actuation device according to this invention, as illustrated in FIG. 1*a*. This is implementable through different delivery times, delivery volumes and/or delivery rates of the pump. The variability which can thus be achieved in the lift paths of the gas exchange valve 1 is illustrated in the diagram according to FIG. 1*b*.

FIG. 1*c* shows a device according to this invention having two gas exchange valves 1 and 1' in which the two gas exchange valves operate according to the same principle described above. Functionally identical parts are provided with the same reference notation but with an additional index prime ('). In addition, cut-off valves 28, 28' are all that is necessary upstream from the two gas exchange valves 1, 1' to be able to subject gas exchange valves 1, 1' to flow in alternation.

In the case of the device according to FIG. 1*d*, which essentially corresponds to that according to FIG. 1*a*, the gas exchange valve 1 is actuated by way of an intermediate lever 30 as a mechanical transmission aid.

An actuation device that operates according to the schematic diagram in FIG. 1*a* is illustrated in FIG. 2 with respect to a piezo pump as the feed pump 6.

The design of the device according to FIG. 2 is described as follows below.

The shaft of the gas exchange valve 1 of an internal combustion engine is designed as a displacement piston 3 which engages displaceably in hydraulic chamber 2 on the end of the shaft facing away from the combustion chamber of the engine. Hydraulic chamber 2 is connected to the hydraulic line 4 which is in turn connected to a delivery chamber 9 of the feed pump 6 which is designed as a piezo pump by way of a one-way valve through which the medium flows in the direction of hydraulic chamber 2 and on the other hand the hydraulic chamber is connected to the supply container 8 for hydraulic fluid by way of the cut-off valve designed as a 2/2-way switching valve 7. The hydraulic line 4 with the delivery chamber 9 of the piezo pump 7 is connected between the switching valve 7 and the storage container 8 by way of a one-way valve 10 through which the medium flows in the direction of delivery chamber 9. The connecting line 11 having one-way valve 5 leading away from the hydraulic line 4 also leads into the delivery chamber 9 of the piezo pump 6. Piezo pump 6 consists of a housing 12 in which are mounted several piezo elements 13, stacked in layers one above the other. In the direction of expansion, these piezo elements 13 act on a displacement element 14 which is designed like a piston and acts on the delivery chamber 9 of the piezo pump 6 and is displaceably driven by piezo elements 13 to accomplish the change in volume inside of delivery chamber 9. Delivery chamber 9 is sealed with respect to the space of the piezo pump housing 12 by the displacement element 14. To prevent tensile stresses, piezo elements 13 which are stacked together are under a prestress by a spring 15 supported on the housing 12 of piezo pump 6. Additional prestressing measures are also possible.

Piezo elements 13 can be acted upon electrically to produce a longitudinal expansion.

The hydraulic chamber 2 with the displacement piston 3 of the shaft of the gas exchange valve 1 guided in it is connected to the hydraulic line 4 in two places. One of these connections, namely an opening 16, is used exclusively to fill the hydraulic chamber 2 in the embodiment according to FIG. 2, while a second opening 17 is used mainly for discharging the hydraulic chamber 2 and has a greater flow resistance than does opening 16. Opening 17 is designed so that its flow resistance is variable due to the displacement piston 3 which passes over this opening, namely such that the flow resistance is increased as the size of the hydraulic chamber 2 becomes smaller. The inflow opening 16 is designed as a one-way valve through which medium flows only in the direction of the interior of hydraulic chamber 2. This valve function is achieved by a spring-loaded ball pressed against the opening 16 from the interior of the hydraulic chamber 2.

When the valve actuation device is inactive, valve 1 is held in the closed position by a spring 19.

The device described above functions as described below.

The piezo pump 6 acts as a high-frequency pump under electric activation of the individual piezo elements 13, this high-frequency pump conveying hydraulic fluid out of the storage container 8 through the one-way valve 10 and the delivery chamber 9 and then the one-way valve 5 into the hydraulic chamber 2 through an oscillating movement of the displacement element 14, thereby opening valve 1. The prerequisite for opening valve 1 is a closed 2/2-way switching valve 7.

To close an open gas exchange valve 1, piezo pump 6 is switched to electrically inactive while at the same time opening the 2/2-way switching valve 7. The hydraulic fluid, which is under pressure in the hydraulic chamber 2, can flow out through opening 17 and through the opened 2/2-way switching valve 7 into the hydraulic storage container 8 so that gas exchange valve 1 is closed under the force of spring 19. Due to an increase in the flow resistance inside of opening 17 of the hydraulic chamber 2, the displacement speed of the valve shaft in closing the gas exchange valve 1 is reduced, so that striking of the valve of the gas exchange valve 1 on the valve seat is prevented.

The 2/2-way switching valve 7 is controlled and/or regulated in combination with the electric activation of the piezo pump 6 so that periodic opening and closing of the gas exchange valve 1 can take place in a fully variable manner.

The embodiment of the device according to FIG. 3 differs from that according to FIG. 2 in that instead of a 2/2-way switching valve 7 an electric volume flow control valve 20 is used. This volume flow control valve 20 permits a delay in the speed of discharging of hydraulic chamber 2 when an electric current is adjusted when gas exchange valve 1 approaches its closed position. Therefore, it is not necessary to provide an additional discharge opening 17 in the hydraulic chamber 2 in comparison with the design in FIG. 2, so that then the one-way function of the hydraulic chamber inlet opening 16 must necessarily be eliminated.

A delay in the restoring movement of the displacement piston 3 may also be achieved even without a discharge opening having a variable cross section or the use of a regulating valve if the feed pump 6, which should essentially be inactive during the restoring movement, is switched to active delivery with a time control to build up a counter-pressure which has a damping effect.

In an embodiment of the device according to FIG. 2, the shaft of valve 1 is connected to a displacement sensor 21 in FIG. 4. In addition, the 2/2-way switching valve 7 is illustrated there in a structurally concrete embodiment.

The concrete structural embodiment of the 2/2-way switching valve 7 there consists of an electromagnetically operable valve-switching device.

Displacement sensor 21 is designed as an inductive displacement sensor. The 2/2-way switching valve 7 is actuated as a function of the displacement signals of displacement sensor 21. The displacement signals may also be used for controlling and/or regulating the feed pump 6.

The embodiment according to FIG. 5 differs from that according to FIG. 4 only in a different type of displacement sensor, which is designed there as an eddy current displacement sensor 22.

In the device according to FIG. 6, a piezo pump 6 actuates a plurality of gas exchange valves 1 via a multi-way switching valve 23. Switching valve 23 is actuated by electromagnetic actuators 24 such that the two gas exchange valves 1 are each acted upon hydraulically to open or close them. This switching valve 23, which is designed as a slide valve, may also be implemented with a piezoelectric design if required by the switching dynamics.

The hydraulic fluid may be kept under pressure in hydraulic storage tank 8, to which end FIG. 6 shows a hydraulic pump 25 acting on the interior of storage tank 8. The compression pressure for the storage tank may of course be derived from any desired pressure source which is already present for other reasons, for example, in a motor vehicle. Due to the pressure acting on the hydraulic fluid in the storage container 8, it is possible to minimize the influence of temperature on the intake performance of piezo pump 6 in particular. When using a hydraulic pump 25, leakage losses can be compensated easily.

FIG. 7 shows an embodiment in which a 2/2-way switching valve 27 which serves as a stop valve is operated by a special camshaft 29, for example. Such a camshaft-actuated operation of the 2/2-way switching valve 27 may be expedient in operation of a gas exchange valve 1, which functions as a discharge valve, in an internal combustion engine which is operated more frequently in braking operation of the engine in a known manner than is the case in motor-drive operation.

In braking operation of the engine in which the gas exchange discharge valves 1 are operated repeatedly in comparison with the drive motor operation for an additional charging and decompression, the discharge valves 1 must be opened while under pressure. In order not to expose the delivery chamber 9 of piezo pump 6 to this elevated pressure, an additional hydraulic actuator 26, e.g., camshaft-actuated, may be provided for controlling the respective discharge valves 1 in engine braking operation, as illustrated in FIG. 8. This hydraulic actuator 26 is connected to the hydraulic chamber 2 in an area between the 2/2-way switching valve 7, 27 and/or the regulating valve 20, which is used as an alternative, and the access opening 16. Piezo pump 6 is actuatable in such a way that it is always switched to inactive when the hydraulic actuator 26 is active for opening the valve 1.

A variable actuator according to this invention has the following advantages in particular.

a: Good system dynamics are obtained due to a highly dynamically operating pump, e.g., a piezo pump and the pressure acting on the hydraulic fluid storage container. A high-pressure reservoir is not necessary. The intake performance of the feed pump is subject only to minimal temperature effects. It is thus possible to use the actuator according to this invention over the entire rotational speed range of the internal combustion engine.

b: Full variability of the opening of the gas exchange valves is achieved such as:

continuous phase shifting of the valve elevation, variable lift setting and valve opening times, variable valve opening time and valve closing time, cylinder shutdown.

This leads in turn to the following:

higher power and torque of the internal combustion engine, low consumption, reduced emissions.

c: The number of components is reduced, namely a camshaft is not necessary, hydraulic valve level equalizing elements are eliminated, it is unnecessary to have a valve brake in a valve displacement measurement.

d: There is a great flexibility in assembly of the components according to this invention.

e: Only a low level of hydraulic noise is generated and power consumption is low because the piezo pump operates only in phases for opening the gas exchange valve.

f: A stop valve downstream from a gas exchange valve inside the hydraulic fluid circuit is subject to reduced dynamic requirements because of the variable operation of the piezo pump, i.e., discontinuously, so that this stop valve can be actuated electromagnetically.

g: No additional stop valve is necessary in the hydraulic fluid circuit upstream from the gas exchange valve; in a conventional hydraulic valve control system, such an additional cut-off valve must operate at a very high dynamic level.

h: A high regulating accuracy is possible when using a displacement measurement of the gas exchange valve because interference quantities such as hysteresis, operating frequency, leakage losses and temperature can be compensated in this way.

What is claimed is:

1. An actuator for actuating the gas exchange valves of an internal combustion engine, whereby the gas exchange valves are actuated by hydraulic fluid conveyed by a feed pump in an open circuit equipped with a storage tank, whereby the opening or closing of the gas exchange valves is produced by actuating forces emanating from the hydraulic fluid flowing through the circuit and acting at different levels on the respective gas exchange valve to be actuated, downstream from the respective gas exchange valve, the flow cross section of the circuit is constricted or even closed with respect to all areas upstream from this gas exchange valve, at least during the duration of a hydraulically actuated opening or closing of the gas exchange valve, the hydraulic actuating force on the gas exchange valve is counteracted by a force, in particular a spring force, characterized in that the feed pump (6) is designed for a delivery operation which operates intermittently and works at a clock frequency above that of the opening and closing frequency of the gas exchange valves.

2. The actuator according to claim 1, characterized in that a mechanical force and/or distance translator (30) is provided between the hydraulic force source and the respective gas exchange valve (1) and cooperates directly with the adjustment mechanism of the respective gas exchange valve (1).

3. The actuator according to claim 1, characterized in that the feed pump (6) is designed with piezoeletric, magnetostrictive and/or electrochemical actuators (13) as delivery elements.

4. The actuator according to claim 1, characterized in that the feed pump (6) is turned off at least during a portion of the period of time when there is no hydraulically actuated opening or closing of a respective gas exchange valve (1).

5. The actuator according to claim 1, characterized in that a shaft of the gas exchange valve (1) is displaceably and tightly inserted into a valve hydraulic chamber (2), which is filled with hydraulic fluid and is connected to the storage container (8) by a line (4) containing the constrictable to closable circulating flow cross section, and it is displaced there to open and close the gas exchange valve (1) with an increase or reduction in size of the hydraulic chamber (2) produced by the hydraulic fluid, and a greater flow resistance is to be overcome by the hydraulic fluid to reduce the size of the hydraulic chamber (2) in comparison with the increase in size of this hydraulic chamber (2).

6. The actuator according to claim 1, characterized in that the constrictable to closable circulating flow cross section is designed as a cut-off valve (7) or a throttling location.

7. The actuator according to claim 6, characterized in that the cut-off valve (7) is a control valve.

8. The actuator according to claim 1, characterized in that a displacement sensor (21, 22) is provided for determining the displacement path of the gas exchange valve (1), and the feed pump (6) is regulated as a function of the positions of the shaft of the gas exchange valve (1) as determined by this sensor (21, 22).

9. The actuator according to claim 1, characterized in that in the case of an actuator, a plurality of gas exchange valves (1) are operable by a feed pump (6) with the help of a multi-way stop valve (23) or a plurality of individual stop valves (7, 28).

10. The actuator according to claim 1, characterized in that the interior of the hydraulic storage tank (8) is under pressure.

11. The actuator for controlling the gas exchange valves of an internal combustion engine according to claim 1 for a driving and braking operation of the internal combustion engine, whereby in braking operation of the engine, the outlet gas exchange valves execute an additional opening/closing cycle during the engine charging and optional decompression procedure in comparison with the engine drive operation, characterized in that a hydraulic actuator (26) which operates separately from the feed pump (6) can act on the hydraulic fluid in the hydraulic chambers (2) of the outlet gas exchange valves (1) for controlling the additional opening/closing cycles of the outlet gas exchange valves (1) in the engine braking operation, while the feed pump (6) is switched to inactive during this actuation time.

12. The actuator according to claim 1, characterized in that a displacement sensor (21, 22) is provided for determining the displacement path of the gas exchange valve (1), and the stop valve (7, 20) is regulated as a function of the positions of the shaft of the gas exchange valve (1) as determined by this sensor (21, 22).

13. A method of operating an actuator for actuating gas exchange valves of an internal combustion engine comprising the steps of:

(a) providing an actuator wherein the gas exchange valves are actuated by hydraulic fluid conveyed by a feed pump in an open circuit equipped with a storage tank, wherein:

the opening or closing of the gas exchange valves is produced by actuating forces emanating from the hydraulic fluid flowing through the circuit and acting at different levels on the respective gas exchange valve to be actuated;

downstream from the respective gas exchange valve, the flow cross section of the circuit is constricted or closed with respect to all areas upstream from this gas exchange valve, at least during the duration of a hydraulically actuated opening or closing of the gas exchange valve; and the hydraulic actuating force on the gas exchange valve is counteracted by a spring force; and (b) operating the feed pump for an intermittent delivery operation at a clock frequency above that of the opening and closing frequency of the gas exchange valves;

wherein the feed pump produces a braking force which acts on the respective gas exchange valve during the period of time in which a respective gas exchange valve is closed through targeted delivery operation within the hydraulic fluid circulation.

* * * * *